US009790043B2

(12) United States Patent
Iijima et al.

(10) Patent No.: US 9,790,043 B2
(45) **Date of Patent: *Oct. 17, 2017**

(54) SHEET CONVEYING DEVICE

(71) Applicant: BROTHER KOGYO KABUSHIKI KAISHA, Nagoya-shi, Aichi-ken (JP)

(72) Inventors: Shota Iijima, Nagoya (JP); Masao Mimoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/263,474

(22) Filed: Sep. 13, 2016

(65) Prior Publication Data

US 2016/0376115 A1 Dec. 29, 2016

Related U.S. Application Data

(63) Continuation of application No. 14/857,565, filed on Sep. 17, 2015, now Pat. No. 9,446,920.

(30) Foreign Application Priority Data

Sep. 25, 2014 (JP) ..... 2014-194546

(51) Int. Cl.
*B65H 3/66* (2006.01)
*B65H 5/36* (2006.01)
(Continued)

(52) U.S. Cl.
CPC ..... *B65H 5/36* (2013.01); *B41J 11/007* (2013.01); *B41J 29/02* (2013.01); *B65H 3/66* (2013.01);
(Continued)

(58) Field of Classification Search
CPC . B65H 3/66; B65H 5/36; B65H 29/52; B65H 2402/40; B65H 2402/53;
(Continued)

(56) References Cited

U.S. PATENT DOCUMENTS 5,368,290 A 11/1994 Nanba
2004/0251613 A1 12/2004 Quesnel
(Continued)

FOREIGN PATENT DOCUMENTS

JP 2012-071563 A 4/2012

*Primary Examiner* — David H Bollinger
(74) *Attorney, Agent, or Firm* — Merchant & Gould P.C.

(57) ABSTRACT

A slider moving in a sliding direction between first and second positions shifts a second path-defining member, relative to a first path-defining member, between first and second states. A pair of movable members each disposed on a corresponding side of a slider in a width direction is movable individually in the sliding direction to shift between third and fourth states. The movable members, when both in the third state, position the slider to the first position and, when both in the fourth state, position the slider to the second position. Each movable member supports a corresponding widthwise end of the slider immovably in the sliding direction and movably in the width direction. A support frame supporting the second path-defining member supports a widthwise central portion of the slider movably in the sliding direction and rotatably on a plane parallel to the sliding direction and the width direction.

7 Claims, 10 Drawing Sheets

(51) Int. Cl.

| | |
|---|---|
| ***B65H 29/52*** | (2006.01) |
| ***B65H 85/00*** | (2006.01) |
| ***B65H 5/06*** | (2006.01) |
| ***B41J 11/00*** | (2006.01) |
| ***B41J 29/02*** | (2006.01) |

(52) U.S. Cl.
CPC ..... *B65H 5/062* (2013.01); *B65H 29/52* (2013.01); *B65H 85/00* (2013.01); *B65H 2402/40* (2013.01); *B65H 2402/46* (2013.01); *B65H 2402/53* (2013.01); *B65H 2403/513* (2013.01); *B65H 2403/541* (2013.01); *B65H 2404/50* (2013.01); *B65H 2404/60* (2013.01); *B65H 2404/6111* (2013.01); *B65H 2404/69* (2013.01); *B65H 2404/693* (2013.01); *B65H 2404/74* (2013.01); *B65H 2404/741* (2013.01); *B65H 2404/7431* (2013.01)

(58) Field of Classification Search
CPC ..... B65H 2404/50; B65H 2404/60; B65H 2404/69; B65H 2404/693; B65H 2404/74; B65H 2404/741; B65H 2404/7431
See application file for complete search history.

(56) References Cited

U.S. PATENT DOCUMENTS

| | | | |
|---|---|---|---|
| 2004/0256793 | A1 | 12/2004 | Dettinger |
| 2009/0057975 | A1 | 3/2009 | Uchida |
| 2011/0052251 | A1 | 3/2011 | Kondo |
| 2014/0353908 | A1 | 12/2014 | Kobayashi |
| 2015/0309460 | A1 | 10/2015 | Yamamoto |

SHEET CONVEYING DEVICE

CROSS-REFERENCE TO RELATED APPLICATION

This application is a continuation of U.S. patent application Ser. No. 14/857,565, filed Sep. 17, 2015 (now U.S. Pat. No. 9,446,920), which further claims priority from Japanese Patent Application No. 2014-194546, filed on Sep. 25, 2014, both of which are incorporated herein by reference in their entirety.

TECHNICAL FIELD

Aspects described herein relate to a sheet conveying device.

BACKGROUND

A known sheet conveying device includes a pair of release levers each disposed on a corresponding one of opposite sides in a right-left direction of an opening through which a feed tray is inserted. By pulling the pair of release levers, one of a first path-defining member and a second path-defining member, which define a part of a conveying path, is moved away from the other. This configuration may facilitate clearing a paper jam and allow insertion into the conveying path a media tray for supporting a medium to be conveyed.

SUMMARY

It may be beneficial to provide a sheet conveying device which comprises a slider for shifting a second path-defining member relative to a first path-defining member, and an individually operable pair of movable members coupled to the slider and in which skew of the slider is reduced or prevented when the individually operable movable members are moved unevenly to move the slider.

According to one or more aspects of the disclosure, a sheet conveying device comprises a first path-defining member configured to define a portion of a conveying path along which a sheet is conveyed, at least one second path-defining member disposed facing the first path-defining member to define a portion of the conveying path, a slider movable in a sliding direction, a pair of movable members each disposed on a corresponding one of opposite sides of the slider in a width direction perpendicular to the sliding direction, and a first support frame supporting the slider and the at least one second path-defining member. The at least one second path-defining member is shiftable between a first state and a second state in which the at least one second path-defining member is further spaced from the first path-defining member than in the first state. The slider is movable in the sliding direction between a first position at which the slider shifts the at least one second path-defining member into the first state, and a second position at which the slider shifts the at least one second path-defining member into the second state. The pair of movable members each is configured to move individually in the sliding direction so as to shift between a third state and a fourth state. The pair of movable members is configured to, when both are in the third state, position the slider to the first position and configured to, when both are in the fourth state, position the slider to the second position. Each of the pair of movable members includes a first support portion configured to support a corresponding one of opposite ends of the slider in the width direction immovably in the sliding direction and movably in the width direction. The first support frame includes a second support portion configured to support a central portion of the slider in the width direction movably in the sliding direction and rotatably on a plane which is parallel to the sliding direction and the width direction.

With the above-described configuration, when both of the pair of movable members are moved evenly so as to be shifted between the third state and the fourth state, the slider translate between the first position and the second position. When one of the pair of movable members is moved unevenly with the other, the slider rotates about a support point of the second support portion.

For example, the at least one second path-defining member comprises a plurality of second path-defining members arranged in the width direction. The slider is configured to shift each of the plurality of second path-defining members into the first state when the slider is at the first position and to shift each of the plurality of second path-defining members into the second state when the slider is at the second position.

Preferably, the sheet conveying device further comprises a restricting unit configured to restrict each of the pair of movable members from moving so as not to shift from the fourth state to the third state.

Preferably, the sheet conveying device further comprises a second support frame movably supporting the pair of movable members. The restricting unit includes a pair of engaging portions located at the second support frame, and an engaged portion located at each of the pair of movable members. The engaged portion is configured to be engaged by a corresponding one of the pair of engaging portions when each of the pair of movable members moves between the third position and the fourth position.

With the above-described configuration, when one of the pair of movable members is in the fourth state while the other is in the third state, the one is reduced or prevented from returning to the third state from the fourth state due to a restoring force of the slider.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
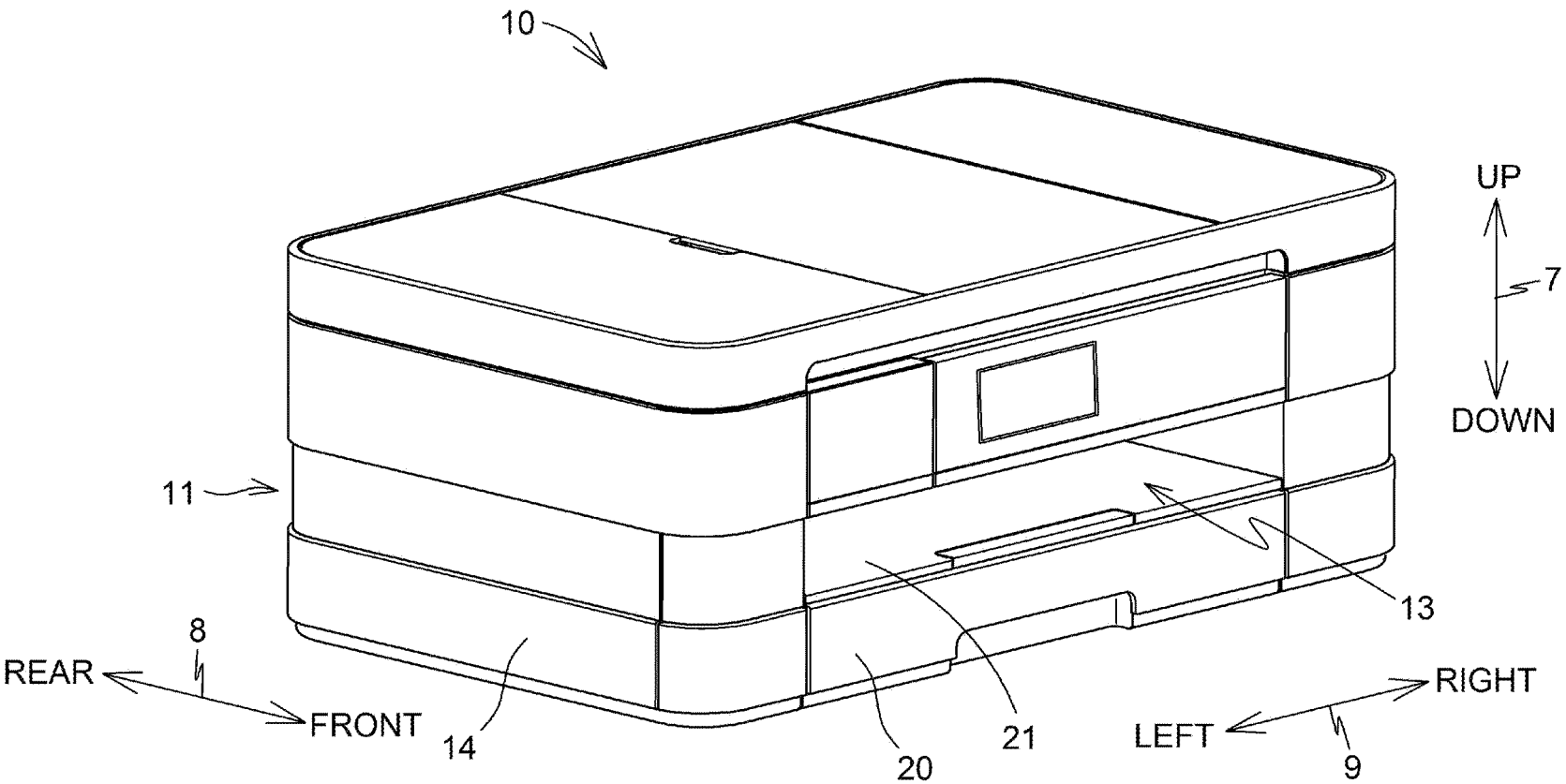
FIG. 1 is a perspective view depicting a multifunction device in an illustrative embodiment according to one or more aspects of the disclosure.

An illustrative embodiment according to one or more aspects of the disclosure will be described below. The disclosure is merely an example and various changes, arrangements and modifications may be applied therein without departing from the spirit and scope of the disclosure. An up-down direction 7 may be defined with reference to an orientation of a multifunction device 10 that may be disposed in an orientation in which it may be intended to be used (refer to FIG. 1). The side of the multifunction device 10, in which an opening 13 may be defined, may be defined as the front of the multifunction device 10. A front-rear direction 8 may be defined with reference to the front of the multifunction device 10. A right-left direction 9 may be defined with respect to the multifunction device 10 as viewed from the front of the multifunction device 10.

[Overall Configuration of Multifunction Device 10]

As depicted in FIG. 1, the multifunction device 10 has a substantially parallelepiped shape. The multifunction device 10 includes a printer unit 11 at its lower portion. The printer unit 11 records an image onto a sheet 12 (refer to FIG. 2) using an inkjet recording method. The printer unit 11 is also capable of recording an image onto a recording medium, e.g., a CD-ROM or a DVD-ROM, supported by a media tray. The media tray has a thickness greater than a sheet 12. The multifunction device 10 has multiple functions, e.g., a facsimile function and a printing function. The multifunction device 10 is an example of a conveying device.

[Housing 14]

As depicted in FIG. 1, the printer unit 11 further includes a housing 14. The housing 14 has the opening 13 defined in its front. The housing 14 has a main conveying path 65 and a return path 66 (refer to FIG. 2) defined therein. The housing 14 may be an exterior cover that defines an internal space therein and accommodates, for example, various components of the printer unit 11 in the internal space.

[Feed Tray 20 and Discharge Tray 21]

Figure 2:
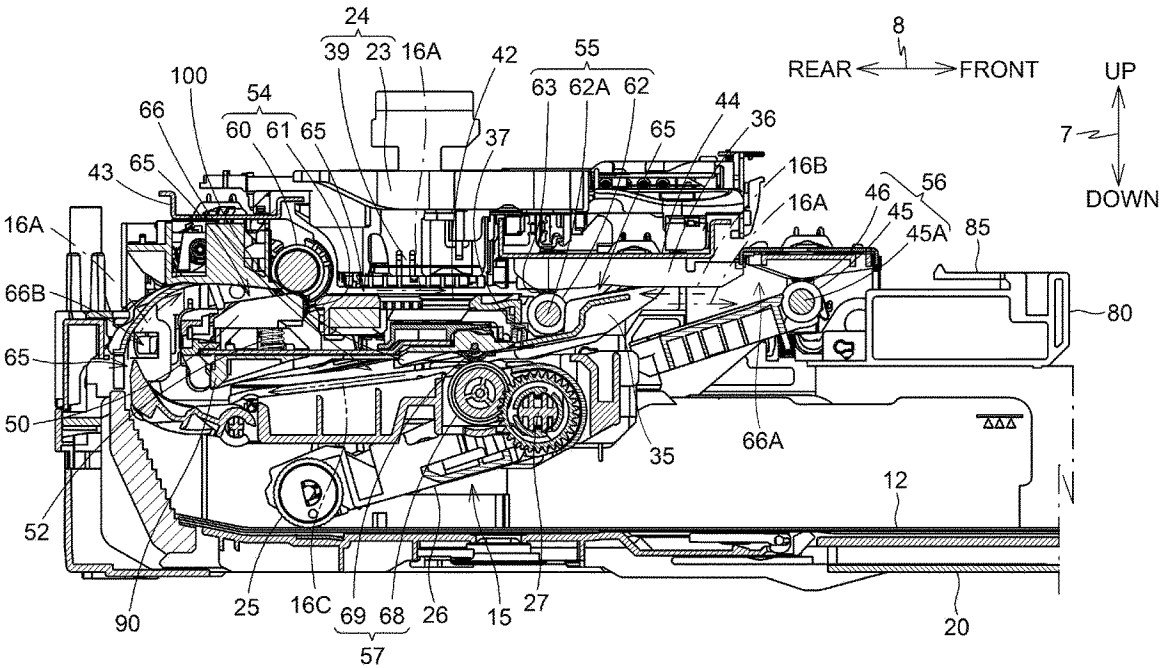
FIG. 2 is a vertical cross-sectional view depicting an internal configuration of a printer unit in the illustrative embodiment according to one or more aspects of the disclosure.

As depicted in FIGS. 1 and 2, the printer unit 11 further includes a feed tray 20 and a discharge tray 21. The feed tray 20 and the discharge tray 21 are configured to be inserted into and removed from the printer unit 11 in the front-rear direction 8 through the opening 13 defined in the front of the printer unit 11. The feed tray 20 is configured to support one or more sheets 12 in a stack. The discharge tray 21 is disposed above the feed tray 20. The discharge tray 21 is configured to support one or more sheets 12 discharged thereon by a discharge roller unit 55.

[Feed Unit 15]

As depicted in FIG. 2, the printer unit 11 further includes a feed unit 15. The feed unit 15 feeds one or more sheets 12 supported by the feed tray 20, one by one, into the main conveying path 65. The feed unit 15 includes a feed roller 25, an arm 26, and a shaft 27. The feed roller 25 is rotatably supported by a distal end of the arm 26. The feed roller 25 is capable of rotating in a normal direction by transmission of a driving force from a motor (an example of a drive source) (not depicted). When the feed roller 25 rotates in the normal direction, the feed roller 25 conveys one or more sheets 12 supported by the feed tray 20, one by one, in a normal conveying direction 16A. The arm 26 is rotatably supported by the shaft 27 supported by a frame of the printer unit 11. The arm 26 is pivotably urged toward the feed tray 20 by its own weight or by an elastic force of, for example, a spring.

[Main Conveying Path 65 and Return Path 66]

The main conveying path 65 and the return path 66 may be spaces defined by a plurality of path-defining members and allow a sheet 12 to pass therethrough. The main conveying path 65 also allows a media tray to pass therethrough. The main conveying path 65 extends from a rear end of the feed tray 20 to the discharge tray 21 via a conveying roller unit 54, a recording unit 24, the discharge roller unit 55, and a reverse roller unit 56. In the illustrative embodiment, the main conveying path 65 includes a curved section and a straight section. The curved section extends curvedly upward from the rear end of the feed tray 20 and turns to the conveying roller unit 54 in a rear portion of the printer unit 11. The straight section extends substantially straightly from the conveying roller unit 54 to the discharge tray 21 via the recording unit 24, the discharge roller unit 55, and the reverse roller unit 56. The normal conveying direction 16A and a reverse conveying direction 16B of a sheet 12 conveyed in the main conveying path 65 are indicated by dot-and-dashed lines with respective arrows in FIG. 2.

The return path 66 guides a sheet 12 to the main conveying path 65 again for changing the up/down orientation of the sheet 12 that has been conveyed in the main conveying path 65. In the return path 66, the sheet 12 is conveyed in a return direction 16C. In the illustrative embodiment, the return path 66 branches off from the main conveying path 65 at a branch point 66A located between the discharge roller unit 55 and the reverse roller unit 56, and joins the main conveying path 65 at a joint point 66B located upstream of the conveying roller unit 54 in the normal conveying direction 16A. The return path 66 is defined below the main conveying path 65 and extends from the branch point 66A to the joint point 66B. The return direction 16C that a sheet 12 is conveyed in the return path 66 is indicated by a double dotted-and-dashed line in FIG. 2.

[Base Member 70]

Figure 3:
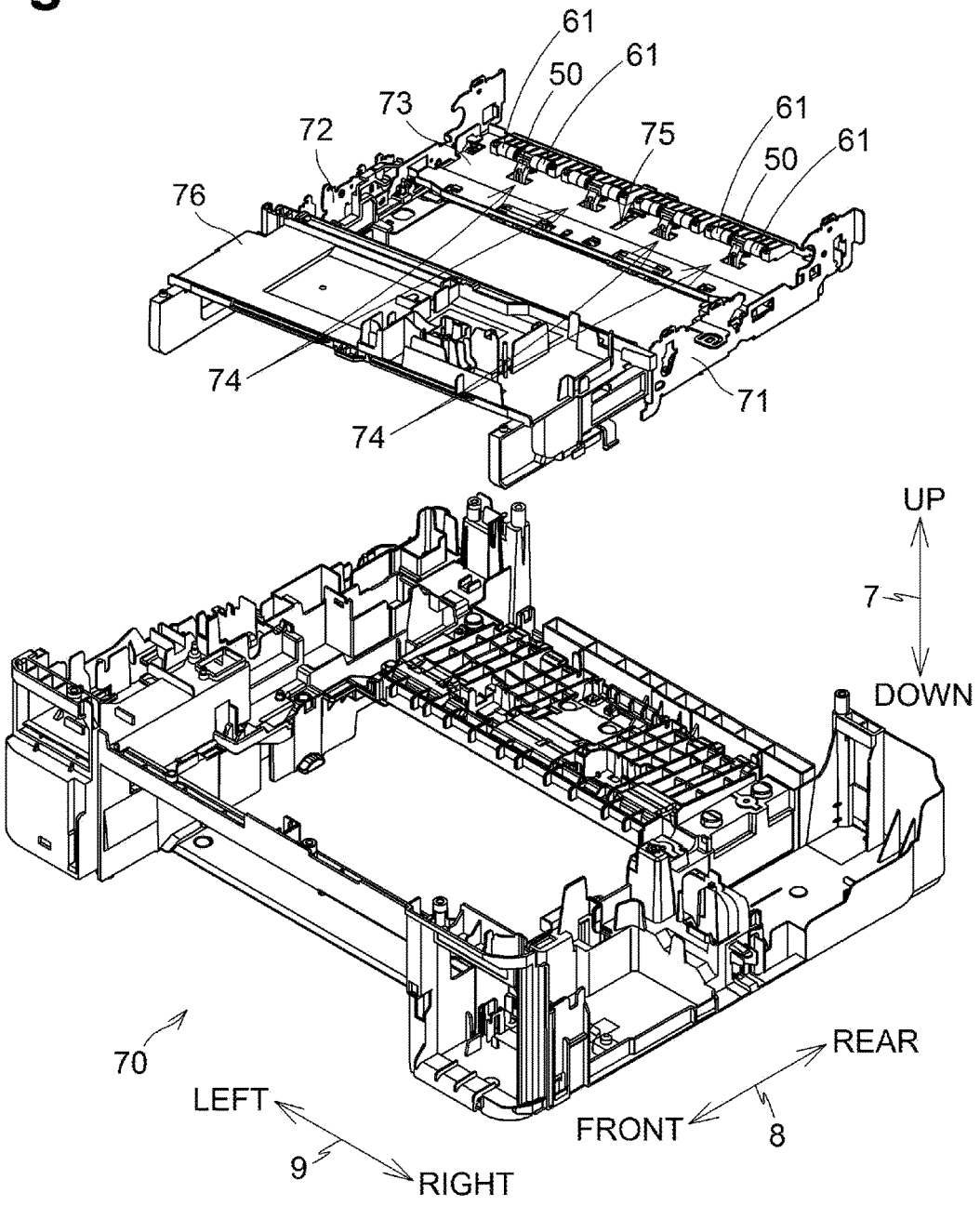
FIG. 3 is a disassembled perspective view depicting a base member, side frames, a first support frame, and a second support frame in the illustrative embodiment according to one or more aspects of the disclosure.
Figure 4:
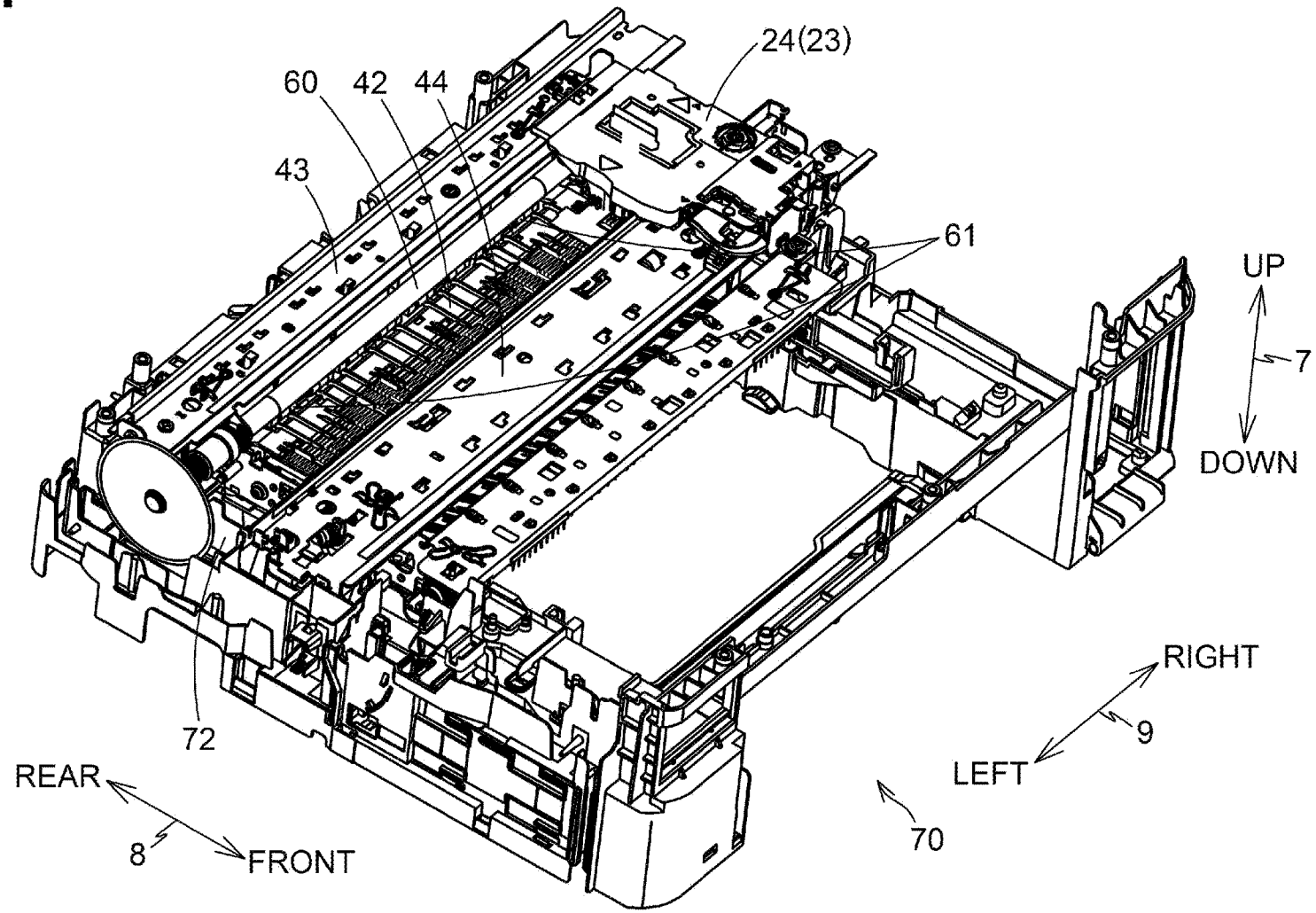
FIG. 4 is a perspective view depicting the base member including a recording unit, a platen, and guide rails in the illustrative embodiment according to one or more aspects of the disclosure.

As depicted in FIGS. 3 and 4, the printer unit 11 further includes a base member 70. The base member 70 may be integrally made of, for example, resin material. The base member 70 has a contact surface of the multifunction device 10 that comes into contact with an installation surface where the multifunction device 10 is installed. The base member 70 has a space therein for accommodating the feed tray 20 and the discharge tray 21. The base member 70 supports the components of the printer unit 11. The base member 70 also serves as one of the plurality of path-defining members and defines a portion of the main conveying path 65 and a portion of the return path 66.

[Side Frames 71 and 72, First Support Frame 73, and Second Support Frame 76]

As depicted in FIG. 3, the printer unit 11 includes side frames 71 and 72, a first support frame 73, and a second support frame 76. The side frames 71 and 72, the first support frame 73, and the second support frame 76 may be made of, for example, metallic material. In the illustrative embodiment, the first support frame 73 and the second support frame 76 are separate parts. Nevertheless, in other embodiments, for example, the first support frame 73 and the second support frame 76 may be integral.

The side frames 71 and 72 are disposed on opposite sides of the main conveying path 65 in the right-left direction 9 (an example of a width direction). The side frames 71 and 72 are supported by the base member 70. The side frames 71 and 72 support the first support frame 73, the second support frame 76, a shaft 62A of a discharge roller 62, a platen 42, a shaft 45A of a reverse roller 45, and guide rails 43 and 44.

The first support frame 73 is disposed between and supported by the side frames 71 and 72. The first support frame 73 supports a plurality of roller holders 50, a slider 90, and a guide member 100. The first support frame 73 has a plurality of through holes 74 defined therein. The through holes 74 are spaced apart from each other in the right-left direction 9 and penetrate the first support frame 73 in a thickness direction of the first support frame 72 at respective positions. The first support frame 73 further has a through hole 75 (an example of an opening). The through hole 75 penetrates the first support frame 73 in the thickness direction of the first support frame 73 at a central portion of the first support frame 73 in the right-left direction 9 while extending in the front-rear direction 8.

The second support frame 76 is disposed in front of the first support frame 73 while being supported by the side frames 71 and 72. The second support frame 76 supports release rods 80A and 80B and a control board (not depicted). The second support frame 76 includes two engaging portions 77 (refer to FIGS. 9A and 9B each illustrating one of the engaging portions 77 only)). Each of the engaging portions 77 is capable of engaging with a protrusion 86 of a corresponding one of the release rods 80. The engagement of the engaging portion 77 of the second support frame 76 and the protrusion 86 of the corresponding release rod 80 restricts the corresponding release rod 80 from moving so as not to shift from a fourth state to a third state. Each of the engaging portions 77 is disposed at a particular position such that each of the engaging portions 77 moving along a corresponding path is able to engage with a corresponding protrusion 86.

[Release Rods 80]

Figure 5:
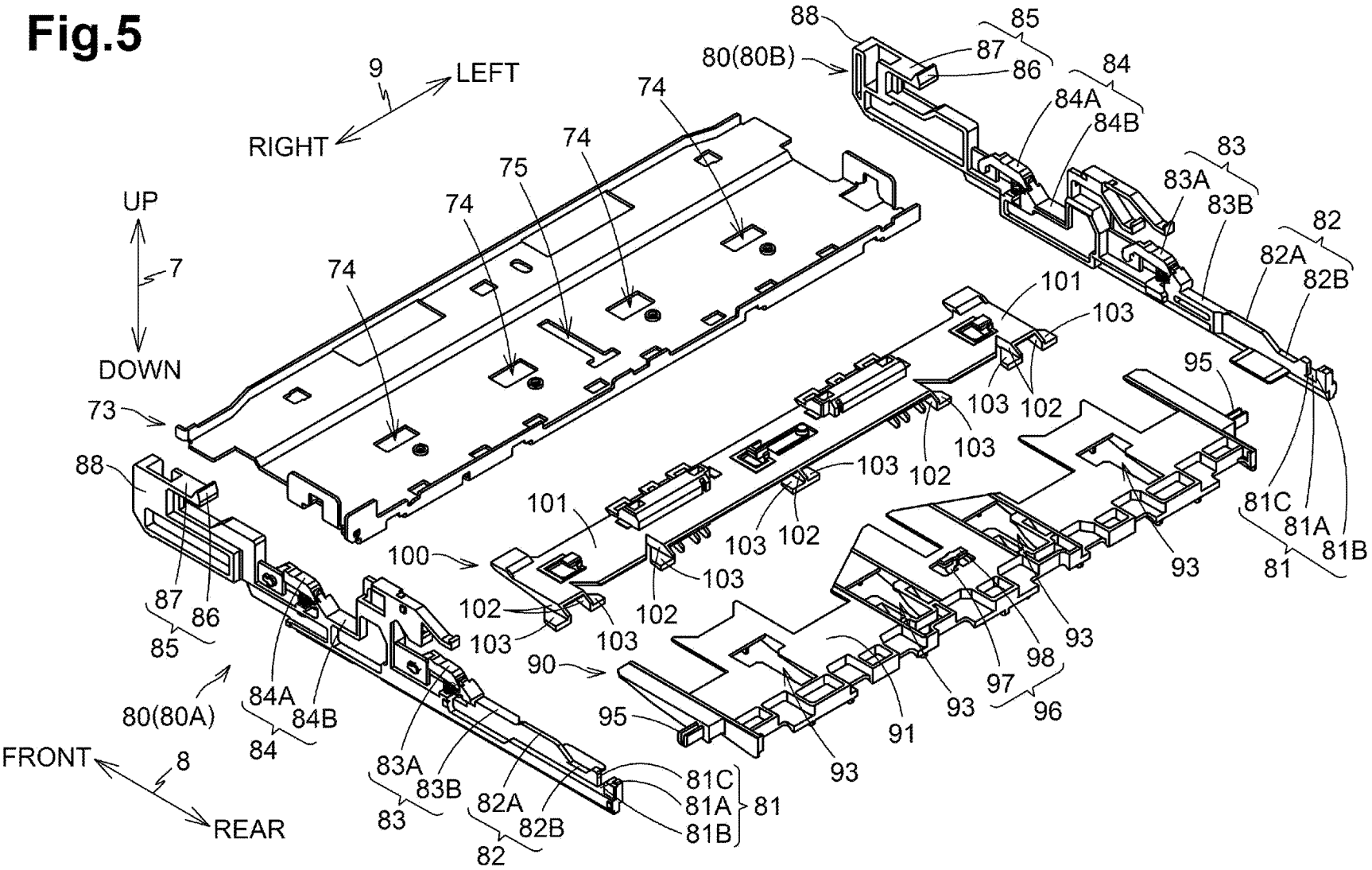
FIG. 5 is a disassembled perspective view depicting release rods, the first support frame, a slider, and a guide member in the illustrative embodiment according to one or more aspects of the disclosure.

As depicted in FIG. 5, the printer unit 11 includes the release rods 80A and 80B (which are collectively referenced as "80" and each of which is an example of a movable member). Each of the release rods 80 may be a plate-like member elongated in the front-rear direction 8. The release rods 80A and 80B are disposed on opposite sides of the main conveying path 65 in the right-left direction 9. The release rods 80A and 80B are shifted between the third state (refer to FIG. 9A) and the fourth state (refer to FIG. 9B) individually by being moved in the front-rear direction 8. For example, each release rod 80 in the fourth state is positioned further to the front than in the third state. Each release rod 80 moves in the front-rear direction 8 while sliding on the second support frame 76 and a corresponding one of the side frames 71 and 72. As the release rods 80A and 80B are shifted to the fourth state (refer to FIG. 9B) from the third state (refer to FIG. 9A) by a user, the slider 90 moves to a second position (refer to FIG. 8B) from a first position (refer to FIG. 8A) and a plurality of pinch rollers 61, the discharge roller 62, the reverse roller 45, and the platen 42 are brought into a second state from a first state.

As depicted in FIG. 5, each of the release rods 80 includes a slider support portion 81 (an example of a first support portion), a platen support portion 82, a discharge-roller support portion 83, and a reverse-roller support portion 84. In the illustrative embodiment, the slider support portion 81, the platen support portion 82, the discharge-roller support portion 83, and the reverse-roller support portion 84 are disposed in this order from the rear in each of the release rods 80 situated in the printer unit 11.

The slider support portion 81 supports a corresponding first supported portion 95 of the slider 90. The slider support portion 81 includes a bottom wall 81A and upright walls 81B and 81C. The bottom wall 81A supports the first supported portion 95 from below. The upright walls 81B and 81C each face the first supported portion 95 in the front-rear direction 8. The slider support portion 81 has open ends in the right-left direction 9. The slider support portion 81 supports the first supported portion 95 immovably in the front-rear direction 8 and movably in the right-left direction 9.

The platen support portion 82 includes an upper-level surface 82A and a lower-level surface 82B. The upper-level surface 82A supports the platen 42 when the release rod 80 is in the third state. The lower-level surface 82B supports the platen 42 when the release rod 80 is in the fourth state. The discharge-roller support portion 83 includes an upper-level surface 83A and a lower-level surface 83B. The upper-level surface 83A supports the shaft 62A of the discharge roller 62 when the release rod 80 is in the third state. The lower-level surface 83A supports the shaft 62A of the discharge roller 62 when the release rod 80 is in the fourth state. The reverse-roller support portion 84 includes an upper-level surface 84A and a lower-level surface 84A. The upper-level surface 84A supports the shaft 45A of the reverse roller 45 when the release rod 80 is in the third state. The lower-level surface 84A supports the shaft 45A of the reverse roller 45 when the release rod 80 is in the fourth state.

Each of the release rods 80 further includes an engaged portion 85. The engaged portion 85 includes the protrusion 86 and a deformable portion 87. The deformable portion 87 may be a thin-plate like member extending in the front-rear direction 8. The deformable portion 87 has one end (e.g., a front end in FIG. 5) that is contiguous with the release rod 80. The deformable portion 87 is elastically deformable in the up-down direction 7 relative to the one end thereof that is contiguous with the release rod 80, for example. The protrusion 86 protrudes upward from the other end of the deformable portion 87 (e.g., a protruding end of the deformable portion 87 or a rear end of the deformable portion 87 in FIG. 5).

The protrusion 86 comes into engagement with a corresponding engaging portion 77 of the second support frame 76 while the release rod 80 is shifted between the third state and the fourth state. In a state where the protrusion 86 of the engaged portion 85 and the engaging portion 77 of the second support frame 76 are in engagement with each other, as a force for moving the release rod 80 in the front-rear direction 8 is further applied to the release rod 80, the deformable portion 87 is elastically deformed downward to disengage the protrusion 86 from the engaging portion 77 of the second support frame 76. The engaging portion 77 of the second support frame 76 and the engaged portion 85 of the release rod 80 are an example of a restricting unit that restricts the release rod 80 from moving and shifting from the fourth state to the third state.

Each of the release rods 80 further includes a handle 88 to be held by the user. The handle 88 is to be held by the user through the opening 13 defined in the front of the printer unit 11. As the user pulls a release rod 80 frontward by holding its handle 88, the release rod 80 shifts from the third state to the fourth state. As the user presses a release rod 80 rearward by holding its handle 88, the release rod 80 shifts from the fourth state to the third state. A handle 88 at an end of a release rod 80 opposite to an end having a slider support portion 81 in the front-rear direction 8 is located farther from the first support frame 73 when the release rod 80 is in the fourth state than when in the third state.

[Conveying Roller Unit 54, Discharge Roller Unit 55, Reverse Roller Unit 56, and Return Roller Unit 57]

As depicted in FIG. 2, the printer unit 11 includes the conveying roller unit 54, the discharge roller unit 55, the reverse roller unit 56, and a return roller unit 57, all of which pinch and convey a sheet 12. The conveying roller unit 54, the discharge roller unit 55, the reverse roller unit 56, and the return roller unit 57 each include at least a pair of rollers facing each other. The conveying roller unit 54, the discharge roller unit 55, and the reverse roller unit 56 define respective portions of the main conveying path 65. The return roller unit 57 defines a portion of the return path 66.

As depicted in FIG. 2, the conveying roller unit 54 is disposed between the joint point 66B and the recording unit 24 in the normal conveying direction 16A. The conveying roller unit 54 includes a conveying roller 60 and a plurality of pinch rollers 61 (an example of a driven roller). The conveying roller 60 rotates upon receipt of a driving force from a motor. The pinch rollers 61 rotate following rotation of the conveying roller 60. The conveying roller 60 is capable of rotating selectively in a normal direction for conveying a sheet 12 in the normal conveying direction 16A and in a reverse direction opposite to the normal direction. As depicted in FIG. 3, the pinch rollers 61 are disposed adjacent to each other in the right-left direction 9 and each face the conveying roller 60. Each of the roller holders 50 supports one or more of the plurality of pinch rollers 61.

Figure 8A:
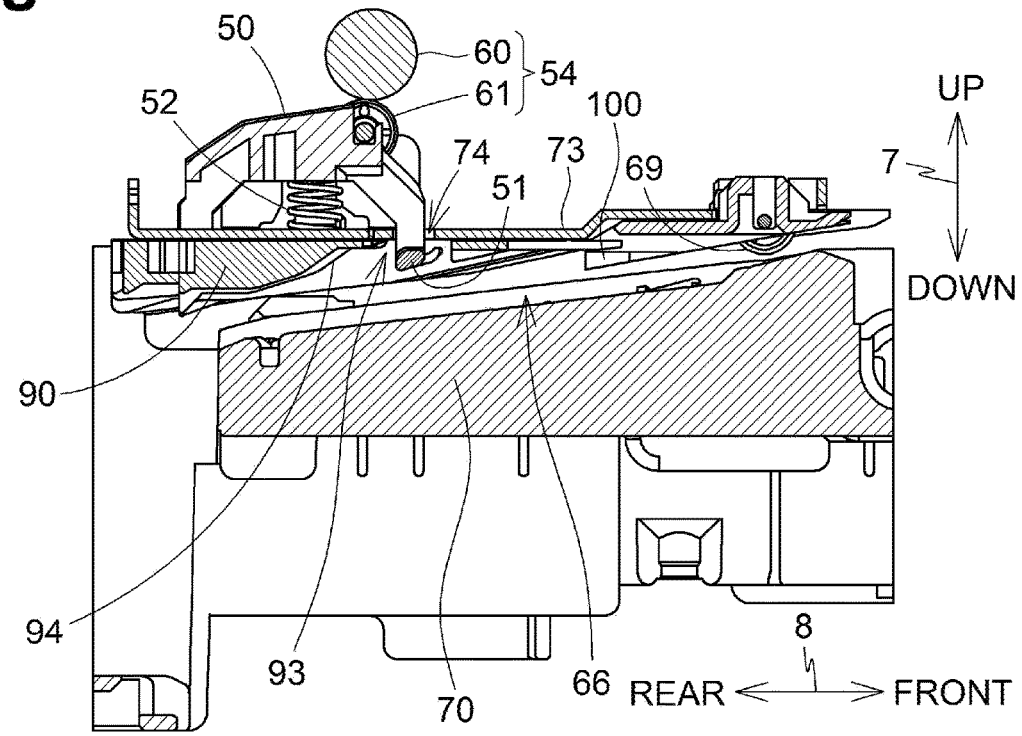
FIG. 8A is a vertical cross-sectional view depicting the slider located at the first position and its surrounding components of the printer unit in the illustrative embodiment according to one or more aspects of the disclosure.
Figure 8B:
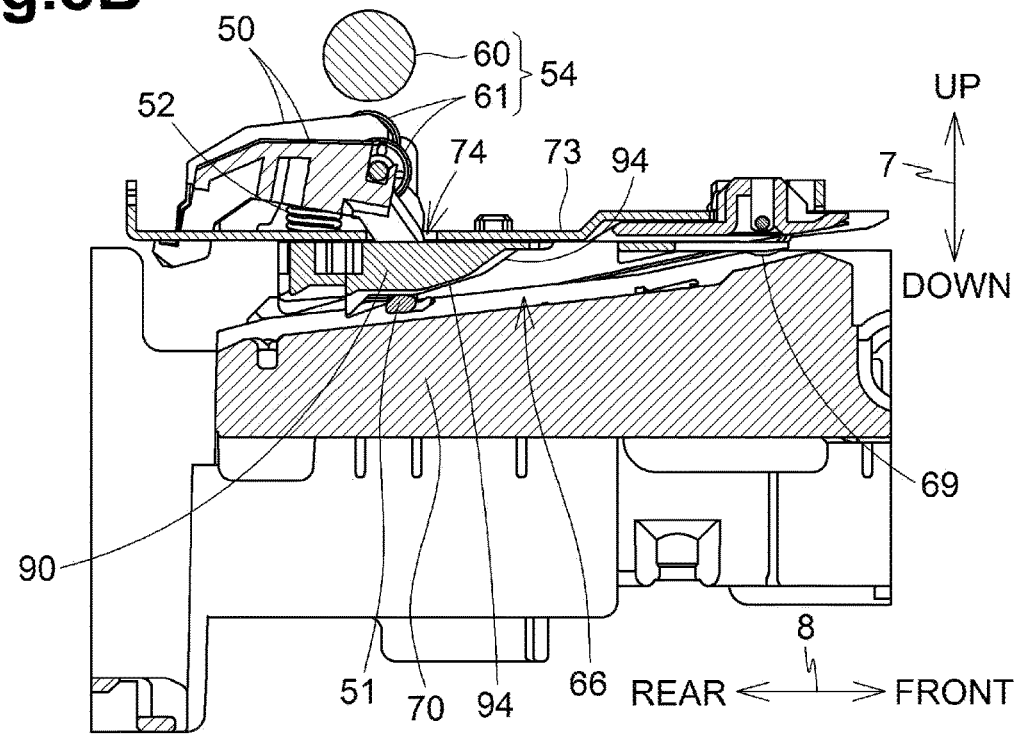
FIG. 8B is a vertical cross-sectional view depicting the slider located at the second position and its surrounding components of the printer unit in the illustrative embodiment according to one or more aspects of the disclosure.

Each pinch roller 61 is configured to be shifted between the first state (refer to FIG. 8A) and the second state (refer to FIG. 8B). When the plurality of pinch rollers 61 is in the first state, the plurality of the pinch rollers 61 is in contact with the conveying roller 60 and thus the conveying roller unit 54 is capable of pinching and conveying a sheet 12. When the plurality of pinch rollers 61 is in the second state, the plurality of the pinch rollers 61 is spaced from the conveying roller 60 and thus the conveying roller unit 54 is capable of pinching and conveying a media tray. When the plurality of pinch rollers 61 is in the first state, the conveying roller 60 and the plurality of pinch rollers 61 may not necessarily be in contact with each other as long as a gap between the conveying roller 60 and the plurality of pinch rollers 61 in the first state is smaller than a gap between the conveying roller 60 and the plurality of pinch rollers 61 in the second state. When the plurality of pinch rollers 61 is in the second state, the gap between the conveying roller 60 and the plurality of pinch rollers 61 may have any size as long as the gap between the conveying roller 60 and the plurality of pinch rollers 61 in the second state is greater than the gap between the conveying roller 60 and the plurality of pinch rollers 61 in the first state. Other path-defining members may also shift their states in the same or similar manner to the conveying roller unit 54.

The roller holders 50 are disposed adjacent to each other in the right-left direction 9 and supported by the first support frame 73. Each of the roller holders 50 supports one or more pinch rollers 61 such that the one or more pinch rollers 61 are rotatable and are changeable in state. As depicted in FIGS. 8A and 8B, the roller holder 50 includes an engagement portion 51. The engagement portion 51 penetrates through a corresponding through hole 74 of the first support frame 73 and is configured to engage with the slider 90. The roller holder 50 is urged by a corresponding coil spring 52 (an example of an urging member) in a particular direction such that the one or more pinch rollers 61 are brought into the first state. The conveying roller 60 is an example of a first path-defining member defining a portion of the main conveying path 65. The pinch rollers 61, the roller holders 50, and the coil springs 52 are each an example of a second path-defining member defining a portion of the main conveying path 65 while facing the conveying roller 60.

As depicted in FIG. 2, the discharge roller unit 55 is disposed between the recording unit 24 and the branch point 66A in the normal conveying direction 16A. The discharge roller unit 55 includes a discharge roller 62 and a plurality of spurs 63. The discharge roller 62 rotates upon receipt of a driving force from the motor. The plurality of spurs 63 rotates following rotation of the discharge roller 62. Similar to the conveying roller 60, the discharge roller 62 is also capable of rotating selectively in a normal direction for conveying a sheet 12 in the normal conveying direction 16A and in a reverse direction opposite to the normal direction. The spurs 63 are disposed adjacent to each other in the right-left direction 9 and each face the discharge roller 62. The discharge roller 62 and the plurality of spurs 63 facing each other serve as ones of the plurality of path-defining members and define a portion of the main conveying path 65. The shaft 62A of the discharge roller 62 is supported by the side frames 71 and 72 and the discharge-roller support portions 83 of the right and left release rods 80A and 80B.

The discharge roller 62 is configured to be shifted between the first state and the second state in response to movement of each of the release rods 80. When the discharge roller 62 is in the first state, the discharge roller 62 is in contact with the plurality of spurs 63. When the discharge roller 62 is in the second state, the discharge roller 62 is spaced from the plurality of spurs 63. In this case, each of the release rods 80 supports the shaft 62A of the discharge roller 62 by the upper-level surface 83A of the discharge-roller support portion 83 to retain the discharge roller 62 in the first state. In this state, the discharge roller unit 55 is capable of pinching and conveying a sheet 12. In the fourth state, each of the release rods 80 supports the shaft 62A of the discharge roller 62 by the lower-level surface 83A of the discharge-roller support portion 83 to retain the discharge roller 62 in the second state. In this case, the media tray is permitted to pass through the portion of the main conveying path 65 defined by the discharge roller unit 55.

As depicted in FIG. 2, the reverse roller unit 56 is disposed downstream of the branch point 66A in the normal conveying direction 16A. The reverse roller unit 56 includes a reverse roller 45 and a plurality of spurs 46. The reverse roller 45 rotates upon receipt of a driving force from the motor. The plurality of spurs 46 rotates following rotation of the reverse roller 45. Similar to the conveying roller 60, the reverse roller 45 is also capable of rotating selectively in a normal direction for conveying a sheet 12 in the normal conveying direction 16A and in a reverse direction opposite to the normal direction. The spurs 46 are disposed adjacent to each other in the right-left direction 9 and each face the reverse roller 45. The reverse roller 45 and the plurality of spurs 46 facing each other serve as ones of the plurality of path-defining members and define a portion of the main conveying path 65. The shaft 45A of the reverse roller 45 is supported by the side frames 71 and 72 and the reverse-roller support portions 84 of the release rods 80A and 80B.

The reverse roller 45 is configured to be shifted between the first state and the second state in response to movement of each of the release rods 80. When the reverse roller 45 is in the first state, the reverse roller 45 is in contact with the plurality of spurs 46. When the reverse roller 45 is in the second state, the reverse roller 45 is spaced from the plurality of spurs 46. In the third state, each of the release rods 80 supports the shaft 45A of the reverse roller 45 by the upper-level surface 84A of the reverse-roller support portion 84 to retain the reverse roller 45 in the first state. In this case, the reverse roller unit 56 is capable of pinching and conveying a sheet 12. In the fourth state, each of the release rods 80 supports the shaft 45A of the reverse roller 45 by the lower-level surface 84A of the reverse-roller support portion 84 to retain the reverse roller 45 in the second state. In this case, the media tray is permitted to pass through the portion of the main conveying path 65 defined by the reverse roller unit 56.

As depicted in FIG. 2, the return roller unit 57 defines a portion of the return path 66 extending between the branch point 66A and the joint point 66B. The return roller unit 57 includes a return roller 68 and a driven roller 69. The return roller 68 rotates upon receipt of a driving force from the motor. The driven roller 69 rotates following rotation of the return roller 68. The return roller 68 is capable of rotating in a normal direction such that the return roller unit 57 conveys, in the return direction 16C, a sheet 12 pinched by the return roller 68 and the driven roller 69. The return roller 68 and the driven roller 69 facing each other serve as ones of the plurality of path-defining members and define a portion of the return path 66.

The printer unit 11 further includes a driving-force transmitting mechanism (not depicted). The driving-force transmitting mechanism transmits driving force of one or more motors to the feed roller 25, the conveying roller 60, the discharge roller 62, the reverse roller 45, and the return roller 68. The driving-force transmitting mechanism includes all or some combinations of gears, pulleys, an endless belt, a planet gear mechanism (e.g., a pendulum gear mechanism), and a oneway clutch. The feed roller 25, the conveying roller 60, the discharge roller 62, the reverse roller 45, and the return roller 68 may be driven by a common motor or may be driven by separate motors individually.

[Recording Unit 24]

As depicted in FIG. 2, the recording unit 24 is disposed between the conveying roller unit 54 and the discharge roller unit 55 in the normal conveying direction 16A. The recording unit 24 faces the platen 42 in the up-down direction 7. The recording unit 24 includes a carriage 23 and a recording head 39. The recording unit 24 and the platen 42 facing each other also serve as ones of the plurality of path-defining members and define a portion of the main conveying path 65.

As depicted in FIGS. 2 and 4, the carriage 23 is supported by the guide rails 43 and 44 extending in the right-left direction 9. The guide rails 43 and 44 are spaced apart from each other in the front-rear direction 8. The guide rails 43 and 44 are supported by the side frames 71 and 72. The carriage 23 is connected with a known belt mechanism disposed at the guide rail 44. The belt mechanism rotates by transmission of a driving force from a motor. The carriage 23 connected with the belt mechanism is capable of reciprocating in a main scanning direction along the right-left direction 9.

As depicted in FIG. 2, the recording head 39 is mounted on the carriage 23. The recording head 39 has a plurality of nozzles (not depicted) defined in its bottom surface. The recording head 39 ejects minute ink droplets from the nozzles. While the carriage 23 reciprocates in the right-left direction 9, the recording head 39 ejects ink droplets onto a sheet 12 supported by the platen 42. Thus, an image is recorded on the sheet 12.

[Platen 42]

As depicted in FIG. 2, the platen 42 is disposed between the conveying roller unit 54 and the discharge roller unit 55 in the normal conveying direction 16A. The platen 42 faces the recording unit 24 in the up-down direction 7. The platen 42 is configured to support, from below, a sheet 12 to be conveyed by the conveying roller unit 54. The platen 42 is supported by the side frames 71 and 72 and the platen support portions 82 of the release rods 80A and 80B.

The platen 42 is configured to be shifted between the first state and the second state in response to movement of each of the release rods 80. When the platen 42 is in the first state, the platen 42 faces the recording unit 24 while being spaced at a predetermined interval from the recording unit 24. When the platen 42 is in the second state, the platen 42 is further spaced from the recording unit 24 than the platen 24 in the first state. In the third state, each of the release rod 80 supports the platen 42 by the upper-level surface 82A of the platen support portion 82 to retain the platen 42 in the first state. In this case, a sheet 12 supported by the platen 42 faces the recording unit 24 while a gap appropriate for image recording is provided. In the fourth state, each of the release rods 80 supports the platen 42 by the lower-level surface 82B of the platen support portion 82 to retain the platen 42 in the second state. In this case, the media tray is permitted to pass through the main conveying path 65 defined by the recording unit 24 and the platen 42.

[Flap 35 and Flap-Facing Member 36]

As depicted in FIG. 2, the printer unit 11 further includes a flap 35 and a flap-facing member 36 between the discharge roller unit 55 and the reverse roller unit 56 in the normal conveying direction 16A. The flap 35 and the flap-facing member 36 face each other in the up-down direction 7. The flap 35 and the flap-facing member 36 facing each other serve as ones of the plurality of path-defining members and define a portion of the main conveying path 65.

The flap 35 is pivotably supported by the platen 42. The flap 35 is pivotable among a first pivot position, a second pivot position, and a third pivot position. As a sheet 12 comes into contact with the flap 35, the flap 35 pivots from the first pivot position to the second pivot position. As each of the release rods 80 shifts from the third state to the fourth state, the flap 35 pivots from the first pivot position to the third pivot position. The flap 35 is urged toward the first pivot position by an urging member, for example, a coil spring 37.

As depicted in FIG. 2, when the flap 35 is located at the first pivot position, the flap 35 guides, to the return path 66, a sheet 12 being conveyed in the reverse conveying direction 16B by the reverse roller unit 56 while blocking the main conveying path 65 by contacting the flap-facing member 36. When the flap 35 is located at the second pivot position, the flap 35 is separated from the flap-facing member 36 and permits a sheet 12 to pass through the main conveying path 65. When the flap 35 is located at the third pivot position, the flap 35 is further spaced from the flap-facing member 36 than the flap 35 located at the second pivot position and permits the media tray to pass through the main conveying path 65.

[Slider 90 and Guide Member 100]

As depicted in FIG. 5, the printer unit 11 further includes the slider 90 and the guide member 100. The slider 90 and the guide member 100 are disposed between the main conveying path 65 and the return path 66 in the up-down direction 7. The slider 90 and the guide member 100 are disposed between the release rods 80A and 80B in the right-left direction 9. In other words, the release rods 80A and 80B are disposed on opposite sides of the slider 90 and on opposite sides of the guide member 100 in the right-left direction 9. The slider 90 and the guide member 100 serve as ones of the plurality of path-defining members and define a portion of the return path 66 while facing the base member 70 (an example of a facing member). More specifically, the slider 90 and the guide member 100 define a portion of the return path 66 from above.

Figure 6:
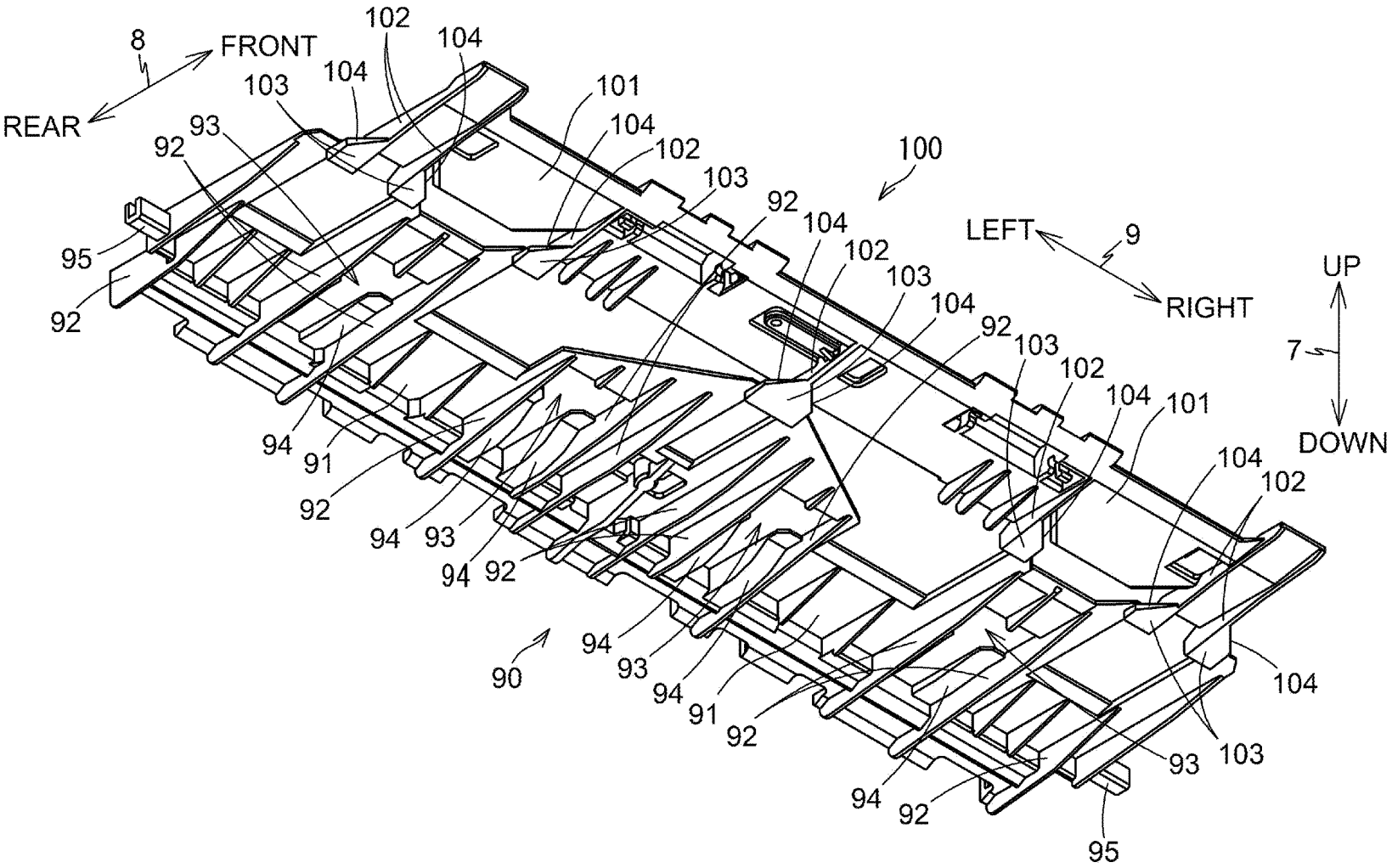
FIG. 6 is a perspective view depicting the slider located at a first position and the guide member according to one or more aspects of the disclosure.
Figure 7:
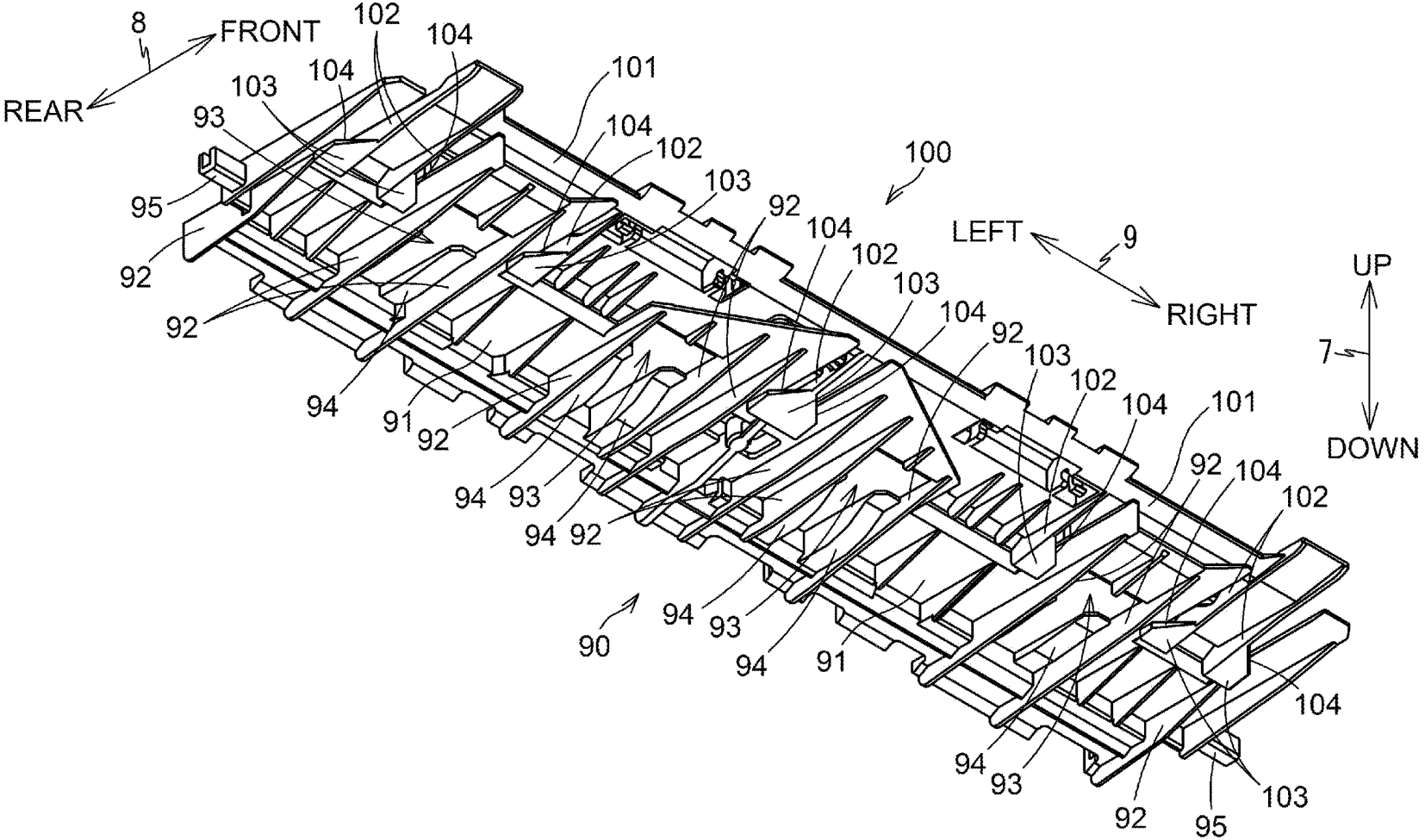
FIG. 7 is a perspective view depicting the slider located at a second position and the guide member in the illustrative embodiment according to one or more aspects of the disclosure.

As depicted in FIGS. 6 and 7, the slider 90 includes a thin plate-like portion 91 and a plurality of ribs 92 disposed at a lower surface of the plate-like portion 91. The ribs 92 are spaced apart from each other in the right-left direction 9. Each of the ribs 92 protrudes downward from the lower surface of the plate-like portion 91 and extends in the front-rear direction 8. An amount of downward protrusion of each of the ribs 92 increases at a downstream portion thereof in the return direction 16C. Each of the ribs 92 guides a sheet 12 being conveyed in the return path 66 using its protruding end.

The slider 90 further has a plurality of through holes 93 defined therein and includes a plurality of inclined surfaces 94. The through holes 93 penetrate the plate-like portion 91 in a thickness direction of the plate-like portion 91 and are elongated in the front-rear direction 8. Each through hole 93 is defined between corresponding adjacent two of the plurality of ribs 92. Two inclined surfaces 94 are disposed on opposite sides of each through hole 93 at the lower surface of the plate-like portion 91 in the right-left direction 9. The inclined surfaces 94 extend in the front-rear direction 8 and are angled relative to the up-down direction 7. As depicted in FIGS. 8A and 8B, the engagement portion 51 of the roller holder 50 comes into contact with a corresponding inclined surface 94 located on either side of the through hole 93 while passing through the through holes 74 and 93.

The slider 90 is supported by the first support frame 73 and the slider support portions 81 of the release rods 80A and 80B so as to be movable between the first position (refer to FIG. 8A) and the second position (refer to FIG. 8B). The first position and the second position may be different positions from each other in the front-rear direction 8 (an example of a sliding direction). More specifically, the second position is further to the front than the first position. As depicted in FIG. 5, the slider 90 further includes first supported portions 95 and a second supported portion 96. The first supported portions 95 are supported by the respective release rods 80A and 80B. The second supported portion 96 is supported by the first support frame 73.

The first supported portions 95 protrude outward from respective ends of the plate-like portion 91 in the right-left direction 9. The first supported portions 95 are supported by the slider support portions 81 of the release rods 80A and 80B, respectively. The slider support portions 81 face each other in the right-left direction 9. Each of the first supported portions 95 moves the slider 90 in the front-rear direction 8 while being retained by a slider support portion 81 of a corresponding release rod 80 as the release rod 80 moves in the front-rear direction 8. The first supported portions 95 are permitted to move in the right-left direction 9 relative to the respective slider support portions 81.

The second supported portion 96 is disposed at a central portion of the slider 90 in the right-left direction 9. The second supported portion 96 includes a projecting portion 97 and a retained portion 98. The projecting portion 97 is disposed at an upper surface of the plate-like portion 91. The retained portion 98 is disposed at a distal end (e.g., an upper end) of the projecting portion 97. The projecting portion 97 penetrates through the through hole 75 of the first support frame 73. The retained portion 98 is supported by an edge portion (an example of a second support portion), which defines the through hole 75, of the upper surface of the first support frame 73. The projecting portion 97 has a substantially circular column shape. The projecting portion 97 has a diameter that is smaller than a dimension in the right-left direction 9 of the through hole 75. The retained portion 98 has a dimension in the right-left direction 9 that is greater than a dimension in the right-left direction 9 of the through hole 75. The through hole 75 includes a wide-open portion at its rear portion. The second supported portion 96 is disposed in the through hole 75 by insertion through the wide-open portion of the through hole 75.

The second supported portion 96 is movable in the front-rear direction 8 within the through hole 75 in accordance with movement of the slider 90 in the front-rear direction 8. That is, the first support frame 73 supports the slider 90 while allowing the slider 90 to move in the front-rear direction 8 relative to the first support frame 73. The second supported portion 96 is rotatable on a plane (typically a horizontal plane) extending both in the front-rear direction 8 and in the right-left direction 9 while passing through the through hole 75. That is, the first support frame 73 supports the slider 90 while allowing the slider 90 to rotate relative to the first support frame 73.

The guide member 100 is supported by the first support frame 73. The guide member 100 is disposed upstream of the slider 90 in the return direction 16C. As depicted in FIGS. 6 and 7, the guide member 100 overlaps the slider 90 in the up-down direction 7. The guide member 100 includes a thin plate-like portion 101, a plurality of guide ribs 102, and a plurality of extending portions 103. The plurality of guide ribs 102 is disposed at a lower surface of the plate-like portion 101. Each of the extending portions 103 extends in the right-left direction 9 from a protruding end of a corresponding guide rib 102.

The guide ribs 102 are spaced apart from each other in the right-left direction 9. Each of the guide ribs 102 protrudes downward from the lower surface of the plate-like portion 101 and extends in the front-rear direction 8. An amount of downward protrusion of each of the guide ribs 102 increases at a downstream portion thereof in the return direction 16C.

Each of the guide ribs 102 guides a sheet 12 being conveyed in the return path 66 using its protruding end.

Each of the extending portions 103 extends in the right-left direction 9 from a protruding end (e.g., a lower end) of a corresponding guide rib 102. At the guide rib 102 disposed at a central portion of the guide member 100 in the right-left direction 9, an extending portion 103 extends bidirectionally along the right-left direction 9 from the extending end of the guide rib 102. At each of the other guide ribs 102, an extending portion 103 extends unidirectionally along the right-left direction 9 from the extending end of each of the other guide ribs 102. The extending portions 103 are spaced from the plate-like portion 101 in the up-down direction 7. The slider 90 is disposed between the plate-like portion 101 and the plurality of extending portions 103.

Each of the extending portions 103 includes an end 104 (e.g., an upstream end in the return direction 16C) that is angled relative to an extending direction thereof and extends obliquely downstream in the return direction 16C. In other words, an amount of protrusion of the extending portion 103 in the extending direction increases at a downstream portion thereof in the return direction 16C. The extending direction refers to a direction away from a corresponding guide rib 102 in the right-left direction 9.

[Movement of Release Rods 80]

Figure 9A:
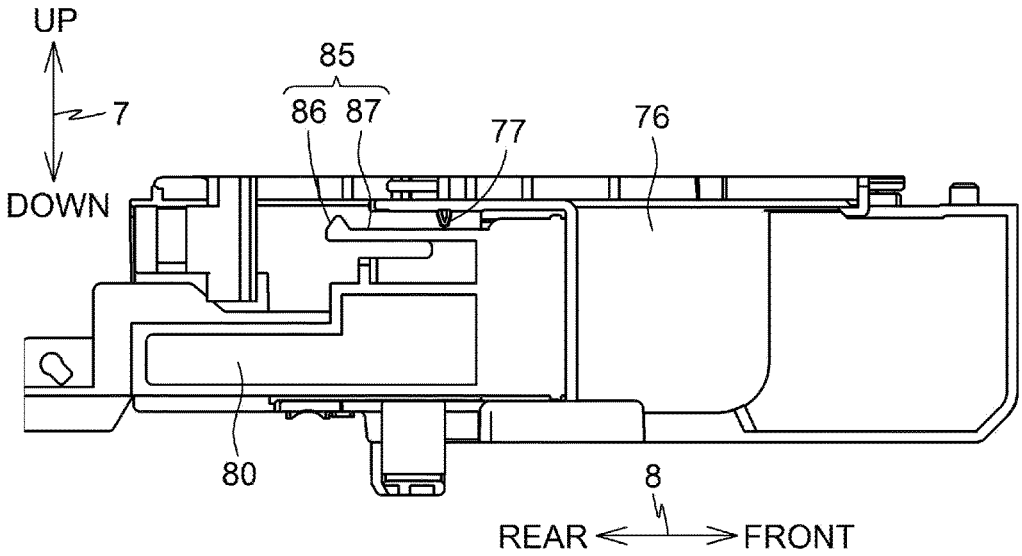
FIG. 9A is a side view depicting an engaging portion of the second support frame and an engaged portion of a release rod located at a third position in the illustrative embodiment according to one or more aspects of the disclosure.
Figure 9B:
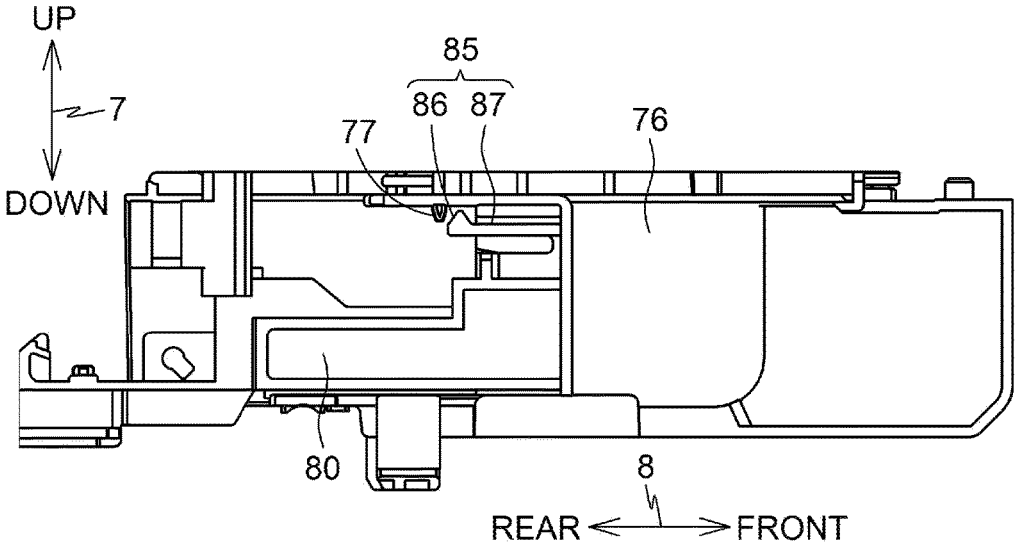
FIG. 9B is a side view depicting the engaging portion of the second support frame and the engaged portion of the release rod located at a fourth position in the illustrative embodiment according to one or more aspects of the disclosure.

Referring to FIGS. 6, 7, 8A, 8B, 9A, and 9B, a description will be provided on a positional relationship among the roller holders 50 (only one of which is illustrated in FIGS. 8A and 8B), the slider 90, the guide member 100, and the restricting unit (e.g., the engaging portions 77 and the engaged portions 85 (only one of each of which is illustrated in FIGS. 9A and 9B)) when the release rods 80A and 80B are moved so as to shift between the third state and the fourth state. A further description of the state changes of the discharge roller 62, the reverse roller 45, and the platen 42 caused by movement of the release rods 80 will be omitted since it has been described above.

When both of the release rods 80A and 80B are in the third state, the slider 90 is located at the first position (refer to FIG. 8A). In this case, as depicted in FIG. 8A, an engagement portion 51 of each roller holder 50 is not in contact with corresponding inclined surfaces 94 of the slider 90. Thus, the roller holder 50 retains one or more pinch rollers 61 in the first state by an urging force of a corresponding coil spring 52. In this case, the discharge roller 62, the reverse roller 45, and the platen 42 are in the first state. When the slider 90 is located at the first position, a gap is provided in the return path 66 to allow passage of a sheet 12.

As depicted in FIG. 6, in a state where the slider 90 is located at the first position, the slider 90 overlaps the guide member 100 over a minimum area. In this state, an end (e.g., an upstream end in the return direction 16C) of the slider 90 is located between the plate-like portion 101 and the plurality of extending portions 103 of the guide member 100 in the up-down direction 7 and downstream of the ends 104 of the extending portions 103 in the return direction 16C. For example, the extending portions 103 cover respective particular portions of the upstream end of the slider 90 located at the first position such that the particular portions of the upstream end of the slider 90 are not exposed to the return path 66. The particular portions of the upstream end of the slider 90 and the respective guide ribs 102 are spaced apart from each other in the right-left direction 9. When each of the release rods 80A and 80B is in the third state, as depicted in FIG. 9A, the engaged portion 85 of each of the release rods 80 is located further to the rear than a corresponding one of the engaging portions 77 of the second support frame 76.

In this state, as the feed roller 25, the conveying roller 60, the discharge roller 62, and the reverse roller 45 rotate in the normal direction, a sheet 12 supported by the feed tray 20 is conveyed in the normal conveying direction 16A along the main conveying path 65 while an image is recorded on one side of the sheet by the recording unit 24. Then, as a leading edge (e.g., a downstream edge of the sheet 12 in the normal conveying direction 16A) of the sheet 12 presses the flap 35, the flap 35 pivots from the first pivot position to the second pivot position against an urging force of an elastic member. As a trailing edge (e.g., an upstream edge of the sheet 12 in the normal conveying direction 16A) of the sheet 12 disengages from the flap 35, the flap 35 returns to the first pivot position from the second pivot position.

Then, as the reverse roller 45 rotates in the reverse direction, the sheet 12 pinched by the reverse roller unit 56 is conveyed in the reverse conveying direction 16B with the upstream edge of the sheet 12 in the normal conveying direction 16A as the leading edge. The sheet 12 is guided into the return path 66 by the flap 35 located at the first pivot position and reaches the return roller unit 57. As the return roller 68 rotates in the normal direction, the sheet 12 pinched by the return roller unit 57 is further conveyed in the return direction 16C along the return path 66 and thus reaches the conveying roller unit 54 again through the main conveying path 65 via the joint point 66B. Thereafter, the recording unit 24 records an image onto the other side of the sheet 12 which has been upside down, while the conveying roller 60, the discharge roller 62, and the reverse roller 45 rotate in the normal direction to convey the sheet 12. After that, the sheet 12 is discharged onto the discharge tray 21.

When both of the release rods 80 are located at the fourth position, the slider 90 is located at the second position. In this state, as depicted in FIG. 8B, an engagement portion 51 of each roller holder 50 is in contact with lower ends of corresponding inclined surfaces 94 of the slider 90 and retains the roller holder 50 at a lower position against an urging force of a corresponding coil spring 52. Thus, the roller holder 50 retains one or more pinch rollers 61 in the second state. In this state, the discharge roller 62, the reverse roller 45, and the platen 42 are in the second state. When the slider 90 is located at the second position, the slider 90 is closer to the base member 70 than the slider 90 located at the first position. In other words, as the slider 90 moves from the first position to the second position, the slider 90 moves toward the base member 70. Thus, the return path 66 when the slider 90 is in the second position (refer to FIG. 8B) has a size in the up-down direction 7 smaller than the return path 66 when the slider 90 is in the first position (refer to FIG. 8A).

When the slider 90 is located at the second position, as depicted in FIG. 7, the slider 90 overlaps the guide member 100 over a larger area than when the slider 90 is located at the first position. In this state, the particular portions of the upstream end of the slider 90 are located upstream of the ends 104 of the respective extending portions 103 in the return direction 16C. When both of the release rods 80A and 80B are located at the fourth position, as depicted in FIG. 9B, the engaged portion 85 of each of the release rods 80 is located further to the front than a corresponding engaging portion 77 of the second support frame 76.

In this state, the media tray is allowed to be inserted into the main conveying path 65. As the media tray is inserted into the main conveying path 65 through the opening 13, the media tray passes through the reverse roller unit 56, the discharge roller unit 55, and the recording unit 24 and the platen 42, and is pinched by the conveying roller unit 54. Then, the conveying roller 60 rotates in one of the normal direction and the reverse direction to convey the media tray to a predetermined position. The recording unit 24 ejects ink therefrom to record an image onto a recording medium supported by the media tray at the predetermined position.

As the user shifts each of the release rods 80 from the third state to the fourth state by holding its handle 88, the upright wall 81B of the slider support portion 81 of each of the release rods 80 presses a corresponding one of the first supported portions 95 of the slider 90 frontward. Thus, while shifting from the third state to the fourth state, each of the release rods 80 moves the slider 90 from the first position to the second position and changes the state of each of the plurality of pinch rollers 61, the discharge roller 62, the reverse roller 45, and the platen 42 from the first state to the second state. While each of the release rods 80 shifts from the third state to the fourth state, the protrusion 86 of the engaged portion 85 of each of the release rods 80 comes into contact with a corresponding one of the engaging portions 77 of the second support frame 76 from the rear in the front-rear direction 8 and then passes frontward under the corresponding engaging portion 77 due to elastic deformation of a corresponding deformable portion 87.

As the user shifts each of the release rods 80 from the fourth state to the third state by holding its handle 88, the upright walls 81C of the slider support portion 81 of each of the release rod 80 presses a corresponding one of the first supported portions 95 of the slider 90 rearward. Thus, while moving from the fourth position to the third position, each of the release rods 80 moves slider 90 from the second position to the first position and changes the state of each of the plurality of pinch rollers 61, the discharge roller 62, the reverse roller 45, and the platen 42 from the second state to the first state. While each of the release rods 80 shifts from the fourth state to the third state, the protrusion 86 of the engaged portion 85 of each of the release rods 80 comes into contact with a corresponding one of the engaging portions 77 of the second support frame 76 from the front in the front-rear direction 8 and then passes rearward under the corresponding engaging portion 77 due to elastic deformation of a corresponding deformable portion 87.

Figure 10A:
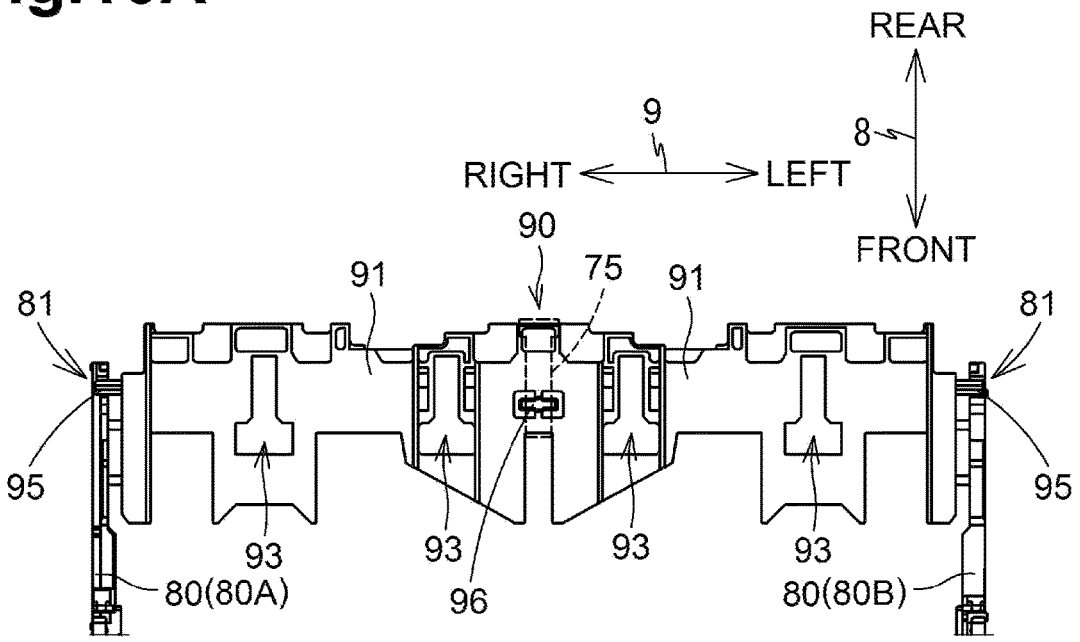
FIG. 10A is a plan view depicting the release rods and the slider when the release rods are moved evenly in the illustrative embodiment according to one or more aspects of the disclosure.
Figure 10B:
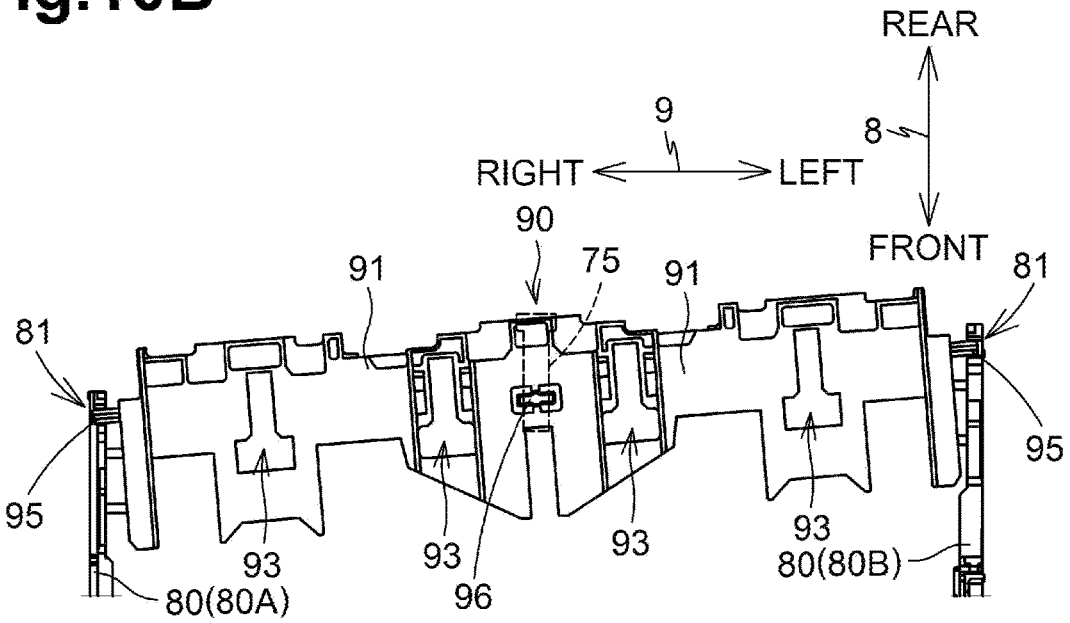
FIG. 10B is a plan view depicting the release rods and the slider when the release rods are moved unevenly in the illustrative embodiment according to one or more aspects of the disclosure.

When both of the release rods 80A and 80B are moved evenly, the release rods 80A and 80B and the slider 90 translate in the front-rear direction 8 while their positional relationship is maintained as depicted in FIG. 10A. For example, when the release rod 80A is moved toward the fourth position from the third position while the release rod 80B remains at the third position, the slider 90 rotates about the second supported portion 96 as depicted in FIG. 10B. When the release rod 80A reaches the fourth position, the protrusion 86 of the release rod 80A comes into engagement with the corresponding engaging portion 77 of the second support frame 76, thereby reducing or preventing an unintentional return of the release rod 80A to the third position.

[Effects Obtained by Illustrative Embodiment]

According to the illustrative embodiment, as depicted in FIG. 10A, when both of the release rods 80A and 80B are moved evenly, the slider 90 translates between the first position and the second position. For example, as depicted in FIG. 10B, when one (e.g., the release rod 80A) of the release rods 80A and 80B is moved unevenly relative to the other, the slider 90 rotates about the second supported portion 96, thereby reducing or preventing skew of the slider 90.

In the state of FIG. 10B, the slider 90 tries to return to the state of FIG. 10A due to a restoring force of the slider 90 whereby the release rod 80A in the fourth state may be pulled toward the third state. In the state of FIG. 10B, when the release rod 80B is shifted to the fourth state while the release rod 80A remains in the fourth state, the release rod 80A may be pulled back toward the third state by the slider 90. In order to reduce or prevent an unintentional return of the release rod 80A to the third state, the engaging portion 77 of the second support frame 76 and the engaged portion 85 of the release rod 80A are configured to engage with each other. Therefore, the engagement of the engaging portion 77 of the second support frame 76 and the engaged portion 85 of the release rod 80A may reduce or prevent the release rod 80A from returning to the third state from the fourth state unintentionally when only the release rod 80A is in the fourth state. With this configuration, the release rods 80A and 80B can be operated and moved individually one after the other.

In the illustrative embodiment, the description has been made on the behavior of the slider 90 when only the release rod 80A is shifted from the third state to the fourth state while the release rod 80B remains in the third state. The configuration according to the illustrative embodiment may also reduce or prevent the skew of the slider 90 when only the release rod 80A is shifted from the fourth state to the third state while the release rod 80B remains in the fourth state. The configuration according to the illustrative embodiment may further reduce or prevent the skew of the slider 90 when only the release rod 80B is shifted to one of the third state and the fourth state while the release rod 80A remains in the other of the third state and the fourth state. The configuration according to the illustrative embodiment may also reduce or prevent the skew of the slider 90 when both of the release rods 80A and 80B are moved simultaneously but their moving amounts are different from each other.

According to the illustrative embodiment, when the slider 90 is located at the first position, the slider 90 is out of contact with each of the roller holders 50. Therefore, in the first state, the plurality of pinch rollers 61 may be positioned with reference to the conveying roller 60, thereby reducing or preventing degradation of accuracy of conveyance of a sheet 12 pinched between the conveying roller 60 and the plurality of pinch rollers 61. According to the illustrative embodiment, the roller holders 50 and the coil springs 52 may be positioned with reference to the first support frame 73. Therefore, the plurality of pinch rollers 61 may be located at its appropriate position in each of the first and second states.

In the illustrative embodiment, the slider 90 is supported at the three points which may be, for example, the two first supported portions 95 and the second supported portion 96. In order to reduce the height of the printer unit 11, the plate-like portion 91 of the slider 90 may preferably have a thinner thickness. Nevertheless, since the plate-like portion 91 has a relatively thinner thickness, the particular portions of the upstream end of the slider 90 may bend toward the return path 66 due to an aged deterioration. In the illustrative embodiment, the particular portions of the downstream end of the slider 90 are covered by the respective extending portions 103 of the guide member 100. Thus, if the particular portions of the upstream end of the slider 90 bend toward the return path 66 due to an aged deterioration, the extending portions 103 of the guide member 100 may reduce or prevent the particular portions of the downstream end of the slider 90 from protruding to the return path 66. Accordingly, this configuration may reduce or prevent the slider 90 from obstructing conveyance of a sheet 12 in the return path 66.

The configuration according to the illustrative embodiment may also be effective in a case where the slider 90 and the guide member 100 define a portion of the return path 66 from below. In this case, the configuration may also reduce or prevent the upstream end of the slider 90 from protruding to the return path 66 due to a dimension tolerance or attachment tolerance. This configuration may be applied to a case where the slider 90 and the guide member 100 define a portion of the main conveying path 65.

According to the illustrative embodiment, when the slider 90 is located at the first position, the particular portions of the upstream end of the slider 90 and the guide ribs 102 are spaced apart from each other in the right-left direction 9, thereby reducing or preventing the guide member 100 from obstructing the rotation of the slider 90 while the guide ribs 102 restrict large movement of the slider 90 in the right-left direction 9. According to the illustrative embodiment, both of the slider 90 and the guide member 100 are supported by the first support frame 73. Therefore, the positioning accuracy of the slider 90 and the guide member 100 may be further increased. According to the illustrative embodiment, the slider 90 is allowed to move in a gap of the return path 66, thereby achieving a size reduction of the printer unit 11.

In the illustrative embodiment, the conveying roller 60 is an example of the first path-defining member, and each of the roller holders 50 each supporting one or more pinch rollers 61 and the coil spring 52 is an example of the second path-defining member. Nevertheless, in other embodiments, for example, each of the spurs 63 may be another example of the first path-defining member and the discharge roller 62 may be another example of the second path-defining member. In still other embodiments, for example, the recording unit 24 may be another example of the first path-defining member and the platen 42 may be another example of the second path-defining member. Each of the spurs 46 may be another example of the first path-defining member and the reverse roller 45 may be another example of the second path-defining member. In each of these cases, for example, the slider 90 may change the state of each of the discharge roller 62, the platen 42, and the reverse roller 45 between the first state and the second state.

In the illustrative embodiment, the return path 66 branches off from the main conveying path 65 at the branch point 66A located downstream of the discharge roller unit 55 in the normal conveying direction 16A, and joins to the main conveying path 65 at the joint point 66B located upstream of the conveying roller unit 54 in the normal conveying direction 16A. Nevertheless, the positional relationship between the main conveying path 65 and the return path 66 is not limited to the specific example. In other embodiments, for example, a return path may branch off from the main conveying path 65 at a branch point located upstream of the conveying roller unit 54 in the normal conveying direction 16A, and joins to the main conveying path 65 at a joint point located upstream of the conveying roller unit 54 in the normal conveying direction 16A. In this case, a sheet 12 having an image recorded on one side may be conveyed in the reverse conveying direction 16B with an upstream edge of the sheet 12 in the normal conveying direction 16A as the leading edge so as to pass under the recording unit 24 and through the conveying roller unit 54. In this way, the sheet 12 may be conveyed into the return path via the branch point and conveyed to the conveying roller unit 54 via the joint point.

While the disclosure has been described in detail referring to the specific embodiment thereof, this is merely an example, and various changes, arrangements and modifications may be applied therein without departing from the spirit and scope of the disclosure.

What is claimed is:

1. A sheet conveying device comprising:

a housing having a particular end;

a first path-defining member configured to define a portion of a conveying path along which a sheet is conveyed;

at least one second path-defining member disposed facing the first path-defining member to define a portion of the conveying path, the at least one second path-defining member being shiftable between a first state and a second state in which the at least one second path-defining member is further spaced from the first path-defining member than in the first state;

a slider movable in a sliding direction between a first position at which the slider shifts the at least one second path-defining member into the first state, and a second position at which the slider shifts the at least one second path-defining member into the second state, the first position being closer to the particular end of the housing than the second position;

a pair of movable members each disposed on a corresponding one of opposite sides of the slider in a width direction perpendicular to the sliding direction, each of the pair of movable members having a first end and a second end opposite to the first end, and a first end of one of the pair of movable members and a first end of the other of the pair of movable members being movable individually relative to the particular end of the housing; and a support frame supporting the slider and the at least one second path-defining member, wherein the slider is configured to move from the first position to the second position when the first end of each of the pair of movable members moves away from the particular end of the housing, and move from the second position to the first position when the first end of each of the pair of movable members moves toward the particular end of the housing, and wherein the support frame includes a support portion configured to support a central portion of the slider in the width direction movably in the sliding direction and rotatably on a plane which is parallel to the sliding direction and the width direction.

2. The sheet conveying device according to claim 1, wherein the support portion of the support frame has an opening extending in the sliding direction, and the slider includes a projecting portion projecting from the central portion of the slider in the width direction and inserted in the opening.

3. The sheet conveying device according to claim 1, wherein the second end of each of the pair of movable members is configured to support a corresponding one of opposite ends of the slider in the width direction immovably in the sliding direction and movably in the width direction.

4. The sheet conveying device according to claim 1, wherein the support portion of the support frame is configured to support the central portion of the slider in the width direction such that the slider is tilted relative to the sliding direction when the first end of one of the pair of movable members and the first end of the other of the pair of movable members move by different distances relative to the particular end of the housing.

5. The sheet conveying device according to claim 1, wherein the at last one second path-defining member comprises a plurality of second path-defining members arranged in the width direction, and wherein the slider is configured to shift each of the plurality of second path-defining members into the first state when the slider is at the first position and to shift each of the plurality of second path-defining members into the second state when the slider is at the second position.

6. The sheet conveying device according to claim 1, wherein the first path-defining member includes a conveying roller configured to be driven by a drive source, and the at least one second path-defining member includes:

a driven roller shiftable between the first state in which the driven roller is in contact with the conveying roller, and the second state in which the driven roller is spaced from the conveying roller;

a roller holder rotatably holding the driven roller; and an urging member configured to urge the driven roller toward the first state, and wherein the slider is configured to, when at the first position, be out of contact with the roller holder and configured to, when moving from the first position toward the second position, contact the roller holder so as to shift the driven roller from the first state to the second state against an urging force of the urging member.

7. The sheet conveying device according to claim 6, wherein the roller holder and the urging member are supported by the support frame.

* * * * *